US009345942B2

(12) United States Patent
Stevens

(10) Patent No.: US 9,345,942 B2
(45) Date of Patent: May 24, 2016

(54) TOWING MECHANISM

(76) Inventor: Kevin Stevens, Tholthorpe (GB)

( * ) Notice: Subject to any disclaimer, the term of this patent is extended or adjusted under 35 U.S.C. 154(b) by 116 days.

(21) Appl. No.: 13/885,594

(22) PCT Filed: Nov. 16, 2011

(86) PCT No.: PCT/GB2011/001616

§ 371 (c)(1),
(2), (4) Date: Jul. 19, 2013

(87) PCT Pub. No.: WO2012/066289

PCT Pub. Date: May 24, 2012

(65) Prior Publication Data

US 2013/0292432 A1 Nov. 7, 2013

(30) Foreign Application Priority Data

Nov. 16, 2010 (GB) ..... 1019363.9

(51) Int. Cl.

| | |
|---|---|
| ***A63B 69/18*** | (2006.01) |
| ***A45F 3/04*** | (2006.01) |
| ***A63C 11/02*** | (2006.01) |
| *A45F 3/00* | (2006.01) |

(52) U.S. Cl.

CPC . *A63B 69/18* (2013.01); *A45F 3/04* (2013.01); *A63C 11/025* (2013.01); *A45F 3/005* (2013.01); *A45F 2003/001* (2013.01); *A63B 69/182* (2013.01); *A63B 2208/12* (2013.01); *A63B 2209/10* (2013.01)

(58) Field of Classification Search

CPC ..... A63B 69/18; A45F 2004/006; A45F 2004/02

USPC ..... 224/184, 153

See application file for complete search history.

(56) References Cited

U.S. PATENT DOCUMENTS

| | | | | | |
|---|---|---|---|---|---|
| 3,937,418 | A * | 2/1976 | Critelli | 242/384.7 |
| 4,621,589 | A * | 11/1986 | Thinnes | 119/770 |
| 4,961,573 | A * | 10/1990 | Wehrell | 482/74 |
| 5,012,964 | A * | 5/1991 | Falletta et al. | 224/153 |
| 5,358,461 | A * | 10/1994 | Bailey, Jr. | 482/2 |
| 5,377,626 | A * | 1/1995 | Kilsby et al. | 119/796 |
| 5,618,249 | A * | 4/1997 | Marshall | 482/127 |
| 5,733,231 | A * | 3/1998 | Corn et al. | 482/120 |
| 5,795,274 | A * | 8/1998 | Kasbohm | 482/115 |
| 5,826,771 | A * | 10/1998 | Peng | 224/651 |
| 5,876,310 | A * | 3/1999 | Mackey et al. | 482/74 |
| 6,099,447 | A * | 8/2000 | Ramsaroop | 482/127 |
| 6,247,427 | B1 * | 6/2001 | DeBien | 119/776 |
| 6,405,683 | B1 * | 6/2002 | Walter et al. | 119/772 |
| 6,526,918 | B1 * | 3/2003 | Arnold | 119/796 |
| 6,792,893 | B1 * | 9/2004 | Quintero et al. | 119/796 |
| 6,904,872 | B2 * | 6/2005 | Muller | 119/796 |
| 7,087,001 | B1 * | 8/2006 | Ihli | 482/115 |
| 7,210,317 | B2 * | 5/2007 | Beane et al. | 70/16 |
| 7,854,694 | B1 * | 12/2010 | Frunzi | 482/124 |
| 2002/0005451 | A1 * | 1/2002 | Valverde | 242/390.2 |
| 2005/0077329 | A1 * | 4/2005 | Sconzo | 224/153 |
| 2005/0252717 | A1 * | 11/2005 | Farrah et al. | 182/3 |
| 2009/0206118 | A1 * | 8/2009 | Sabbah | 224/652 |

* cited by examiner

*Primary Examiner* — Brian D Nash

(74) *Attorney, Agent, or Firm* — Simana Rao, Esq.; McNeely, Hare & War LLP

(57) ABSTRACT

There is described a carrier, such as a backpack, waist bag or bum bag, which includes a retractable towing belt assembly, suitable for towing children along a ski slope.

17 Claims, 5 Drawing Sheets

TOWING MECHANISM

CROSS-REFERENCE TO RELATED APPLICATIONS

Figure 1:
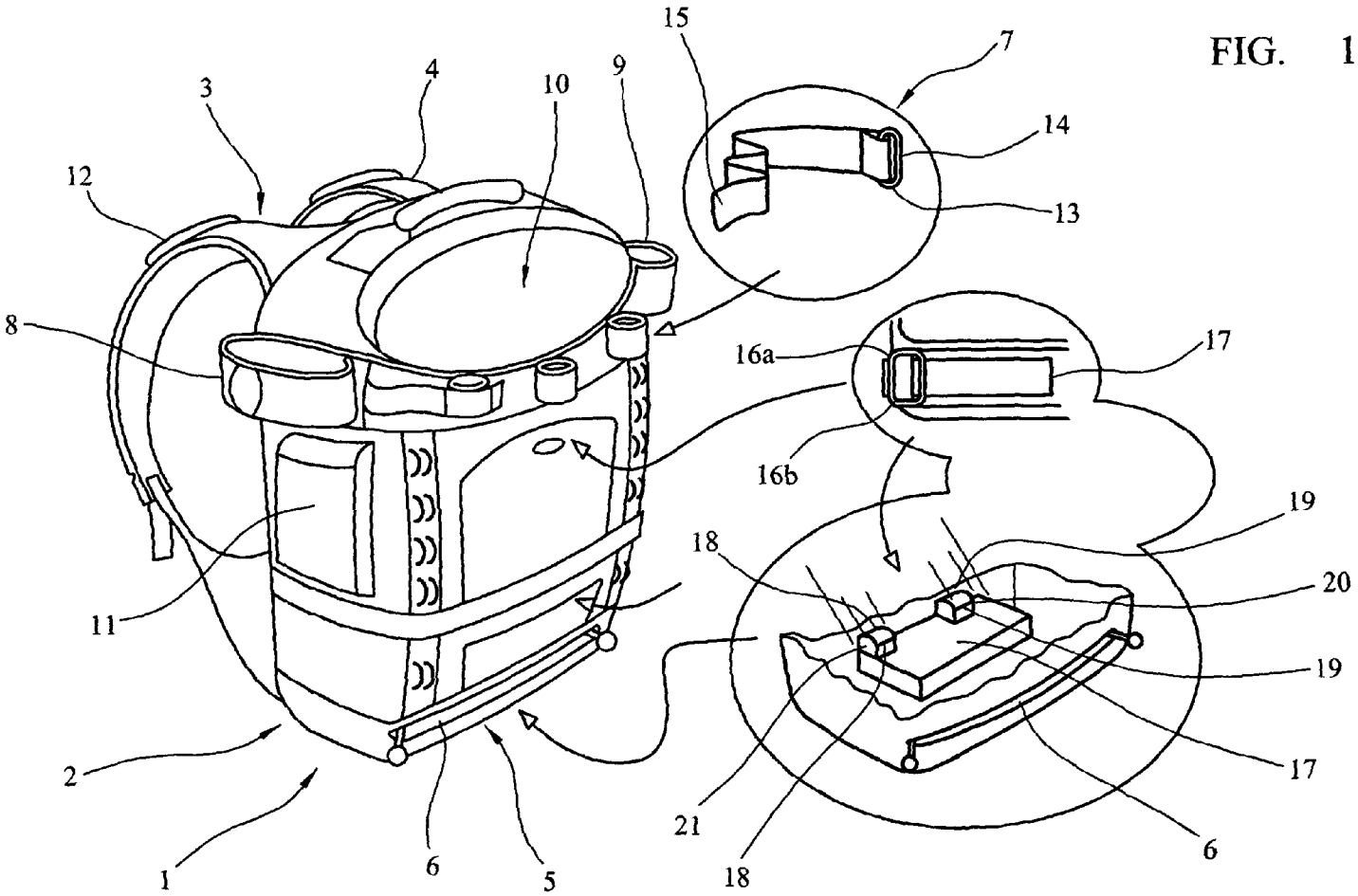

This application claims priority to and is a National Phase Application under 35 USC 371 of PCT/GB2011/001616, filed Nov. 16, 2011 (published as WO 2012/066289), which claims benefit of priority to Great Britain Application No. 1019363.9, filed Nov. 16, 2010. The disclosures of the prior applications are considered part of and are incorporated by reference in their entirety in the disclosure of this application.

FIELD OF THE INVENTION

The present invention relates to a novel mechanism comprising an assembly for the towing of children, objects and the like, for example when skiing.

More particularly the present invention relates to a novel towing mechanism comprising a retractable towing assembly which can be incorporated into a carrier, which may be a backpack, waist bag, bum bag and the like and therefore the novel carrier incorporating the towing mechanism also forms an aspect of the present invention.

BACKGROUND OF THE INVENTION

After skiing or sledging down a slope with children, an accompanying adult will generally pull the child or children back up a slope or along a level area, by, for example, holding the child's hand, pushing them or carrying the child's skis and poles so they can walk, for example holding the child's hand. In addition, the accompanying adult will often also need to carry their own and the child's ski poles and other skiing equipment. This can be burdensome for the adult and may often strain, for example, the back or arm muscles of the adult.

There have been very few/no attempts to address this problem previously.

Retractable leads or are known. Thus, for example, U.S. Pat. No. 3,937,418 describes a retractable dog leash which comprises a spring loaded wheel for rewinding a portion of the leash. However, the dog leash assembly requires a complex ratchet, shaft and switch assembly to enable the user to restrict the extension and/or retraction of the leash.

US patent application No. 2002/0005451 describes a motorised retractable ski tow rope system. The ski tow rope system disclosed therein is heavyweight, complex and expensive, since it includes an electric motor and a clutch and brake assembly.

SUMMARY OF THE INVENTION

The present invention provides a carrier comprising a portable retractable towing belt assembly for use, for example, on ski slopes, sledging areas, and the like. But, unlike a dog leash assembly, there is no requirement to intermittently restrict the extension or retraction of the towing belt. Therefore, the retractable towing belt assembly can be simplified and may be manufactured in a more cost effective manner, etc.

Therefore, according to a first aspect of the invention there is provided a carrier which includes a retractable towing belt assembly.

The retractable towing belt assembly is portable and may be integral to the carrier or may be provided as a separate retractable towing belt unit which may optionally be provided with means for attaching the retractable towing belt unit to the carrier. Also, the carrier may itself be modified to receive the retractable towing belt unit.

The carrier preferably comprises a backpack, but may optionally comprise a waist bag, bum bag and the like. The carrier is intended to be strapped to an individual so that they may utilise the towing belt assembly whilst leaving their hands free. Therefore, for the purpose of the present invention, this is described as a hands-free carrier.

Preferably, the carrier is provided with a compartment for housing a retractable towing belt assembly. When the carrier is a backpack, such a compartment may be positioned in a variety of locations on or in the backpack, however, it is preferred that a compartment for the retractable towing belt assembly is located at the base of the backpack (i.e. when the backpack is in a conventional upright position). The compartment will be provided with an opening, which may, for example, be closed with a zip or the like. Desirably, the compartment opening will be relatively narrow, to enable a child's hand(s) to be inserted into the compartment, but dimensioned so as to prevent the retractable towing belt unit from protruding through the opening when the towing belt is not in use. Furthermore, the compartment may be dimensioned such that the retractable towing belt unit, i.e. the housing or cartridge, may be located at the rear of the compartment, i.e. distal to the opening, such that there is some distance between the wall of the retractable towing belt unit and the opening. Such an arrangement is advantageous in that the retractable towing belt unit or the towing belts are prevented from protruding through the opening when the towing belt is not in use as hereinbefore described. The housing or cartridge may be held in position in the compartment of the carrier buy the use of a fastening means, for example, one or more straps may be located in the compartment, the one or more straps may then be fastened around the housing or cartridge. The straps may comprise a portion that has a Velcro™ or hook and eye type fastener.

The portable retractable towing belt assembly as hereinbefore described is also novel per se. Therefore, according to a further aspect of the present invention there is provided a portable retractable towing belt assembly which comprises:

- a housing or cartridge provided with an aperture for communicating from the interior of the housing or cartridge to the exterior;
- a rotatable reel located in the interior of the housing or cartridge, the reel being provided with a biasing means providing torque in an inwardly winding direction;
- and a tow belt having a first internal end located about and fixed to the reel and a second unfixed external end, the external end optionally being provided with a handle.

It will be understood by a person skilled in the art that a retractable towing belt assembly as hereinbefore described in a housing or cartridge may comprise one or more than one reel and belt arrangement. A simpler assembly may comprise a single reel and belt arrangement. However, an assembly comprising two, three, four or more reel and belt arrangements are envisaged. In an especially preferred aspect of the present invention the retractable towing belt assembly comprises a pair of reel and belt arrangements. Such an assembly is advantageous in that, inter alfa, when a towing a child the child may more easily balance, etc.

The tow belt material may vary depending upon, inter alfa, the intended use of the towing assembly. Thus, it may comprise a belt of a fabric belt, a strap, a cord, a rope, and the like of conventional materials known per se.

The length of the belt may vary. Preferably when more than one belt is present each of the belts will be substantially the same length, although it is within the scope of the present invention for belts of different lengths to be used, for example, depending upon the age of the child intended to be towed, etc. When the retractable towing belt assembly of the invention is intended for use in towing a child on skis then an optimum length of the belt would be sufficient such that the child's skis would not snag with those of the individual wearing the carrier, e.g. a backpack. We have found that an optimum belt length is about 1.7 m. However, it will be understood that this should be a non-limiting factor.

Each of the one or more tow belts is desirably provided with a handle region at the end of the belt. The handle may be in the form of a reinforced loop or may comprise a bar type handle, for example, the type of handle used in conjunction with a water-ski tow line.

The biasing means providing torque in an inwardly winding direction to the rotatable reel may be located on the outside of the reel, e.g. at one end of the reel or it may inside the reel. Thus, for example, the reel may comprise a hollow cylinder, that is a cylinder with a hollow longitudinal core and the biasing means may be located inside the hollow core, e.g. inside the hollow cylinder of the reel. Indeed, it is a preferred embodiment for the reel to be hollow and the biasing means to be located inside the hollow core. This is advantageous in that, inter alia, the whole assembly may be lightweight, compact, etc.

It will be understood by the person skilled in the art that a variety of biasing means may be utilised to provide the required torque to the reel. However, a preferred biasing means is one or more coiled springs, preferably a single spring.

The torque provided by the spring may vary depending upon the weight of the belt material, the intended use of the towing belt assembly. Thus, by way of example only, the assembly may be provided with a spring which has a load of from 10 to 300 Newtons. It will be understood that the spring load may be varied, however, if the spring load is too low then the belt may retract too slowly or not far enough, and, similarly, if the spring load is too high then the belt may retract too quickly and may have the potential to cause injury. Desirably the spring is selected so that it is not fully unwound when the belt is fully extended.

Thus, the carrier and the separate retractable towing belt unit may be provided in kit form. Therefore, according to a yet further aspect of the invention we provide a kit comprising, in a first part, a carrier, e.g. a backpack, waist bag, bum bag and the like; in a second part, a retractable towing belt unit, e.g. in a housing or cartridge, as hereinbefore described. Optionally, the carrier may be modified to receive the retractable towing belt unit and/or the retractable towing belt unit is provided with means for attaching it to a carrier.

The term "backpack" will be well understood by the person skilled in the art and shall include, but shall not be limited to, for example, haversack, knapsack, pack, rucksack, etc.

When the carrier is a backpack, the backpack according to the invention may be provided with other straps, fastenings and pockets as is conventional in the art. In particular since the backpack of the present invention is intended for use by, inter alfa, skiers, it is particularly desirable to include one or more means of carrying skis, ski poles, and the like. Although any conventionally known means may be utilised in the backpack of the invention, a preferred arrangement is to provide one or more straps attached to the backpack, the one or more straps being provided with a fastening means, such as, a hook and loop fastener, e.g. Velcro™ suitable for carrying skis, ski poles, and the like, especially two or more pairs of skis and/or ski poles.

According to a yet further aspect of the invention we provide a method of towing an object which comprises providing a carrier, e.g. a backpack, waist bag, bum bag and the like, which includes a retractable towing belt assembly, e.g. in a housing or cartridge.

In a preferred aspect of the invention the object may be, for example, a child. Furthermore, the method preferably comprises towing the object, e.g. a child, along a smooth surface, for example an ice or snow surface and the like.

However, it will be understood by the person skilled in the art that the carrier and/or the method described herein may be utilised in other snow sports, for example, snow-boarding, sledging, etc. In addition, the towing assembly may optionally be used with older children and adults.

Figure 2A:
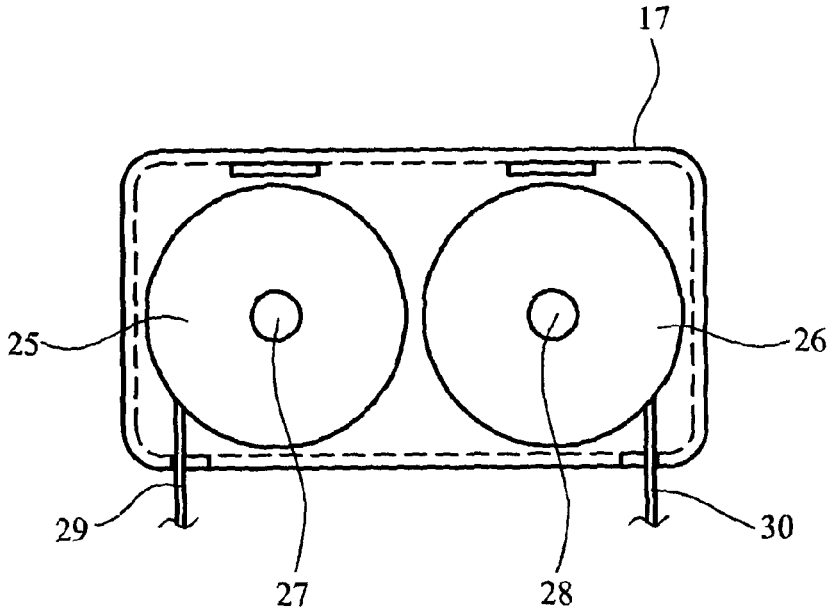
Figure 2B:
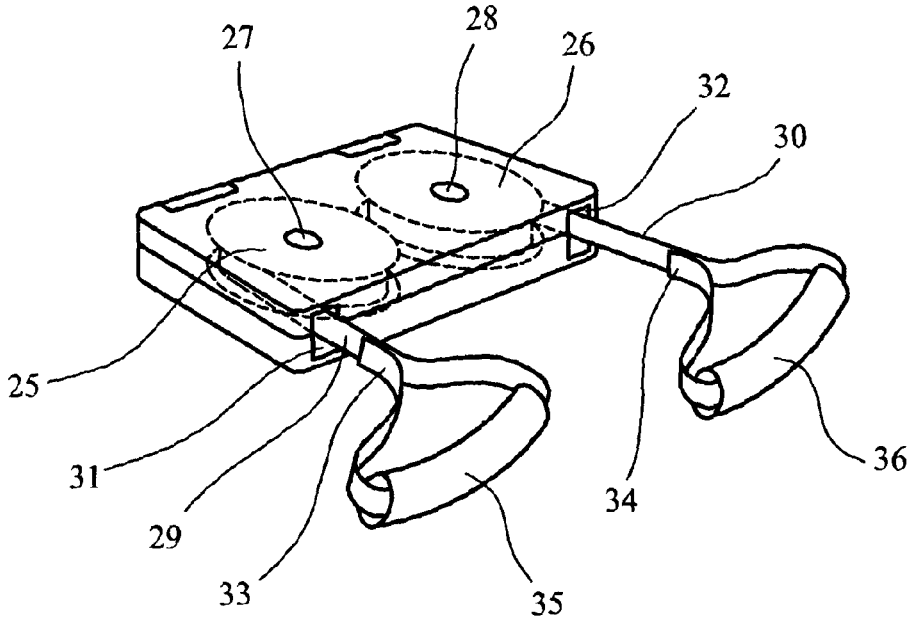
Figure 3B:
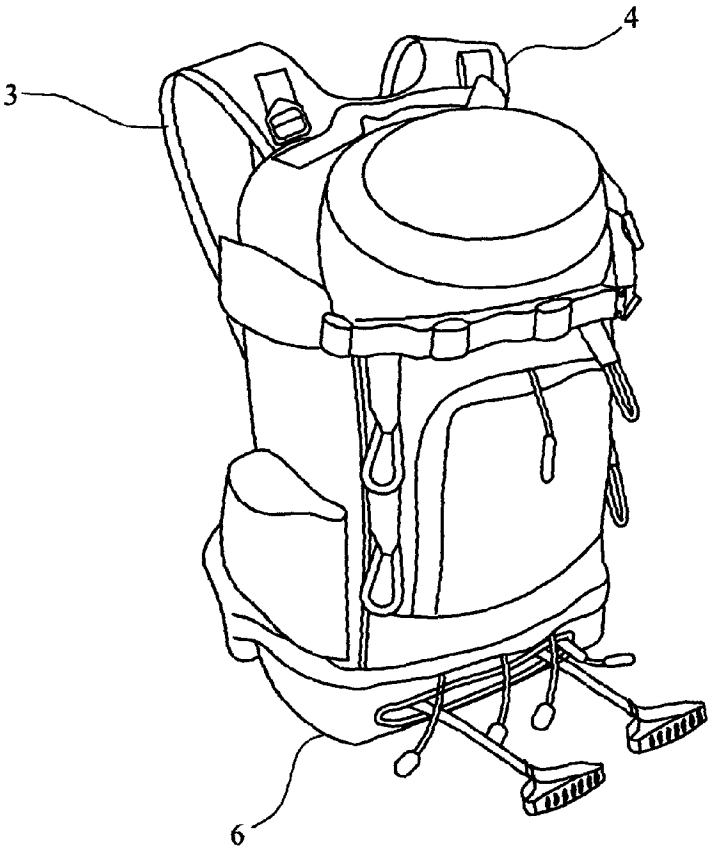
Figure 3A:
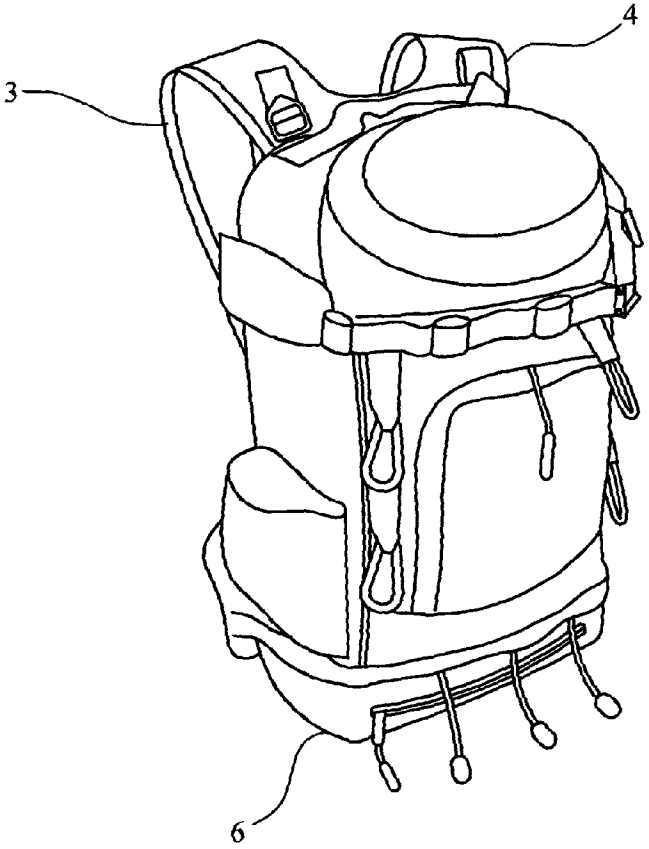
Figure 4A:
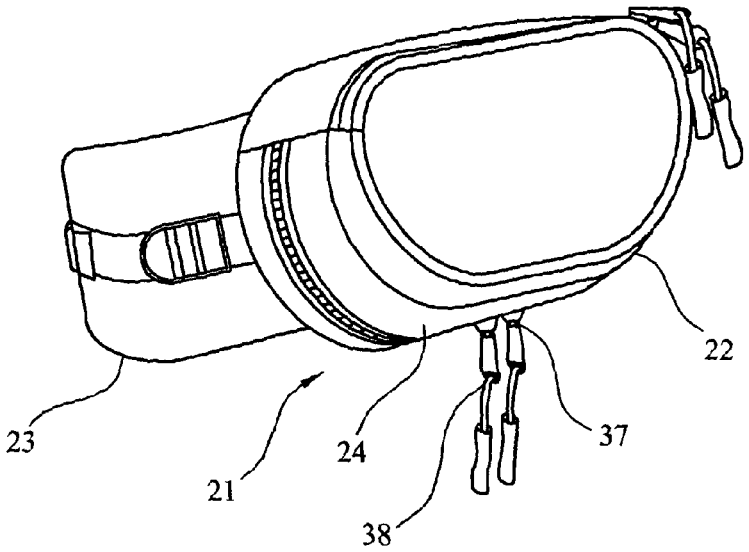
Figure 4B:
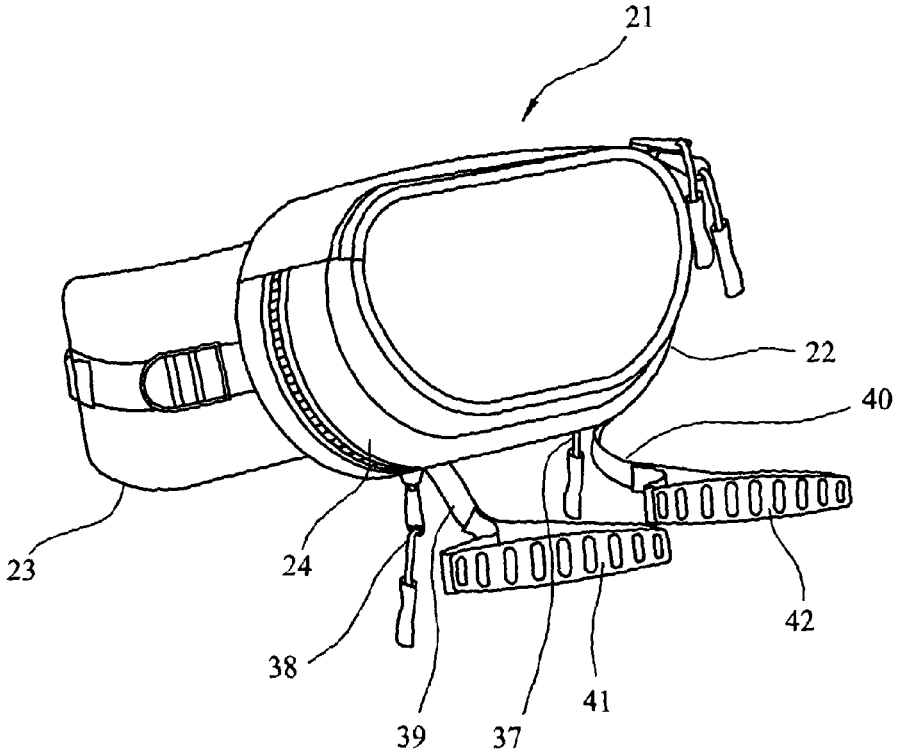
Figure 5:
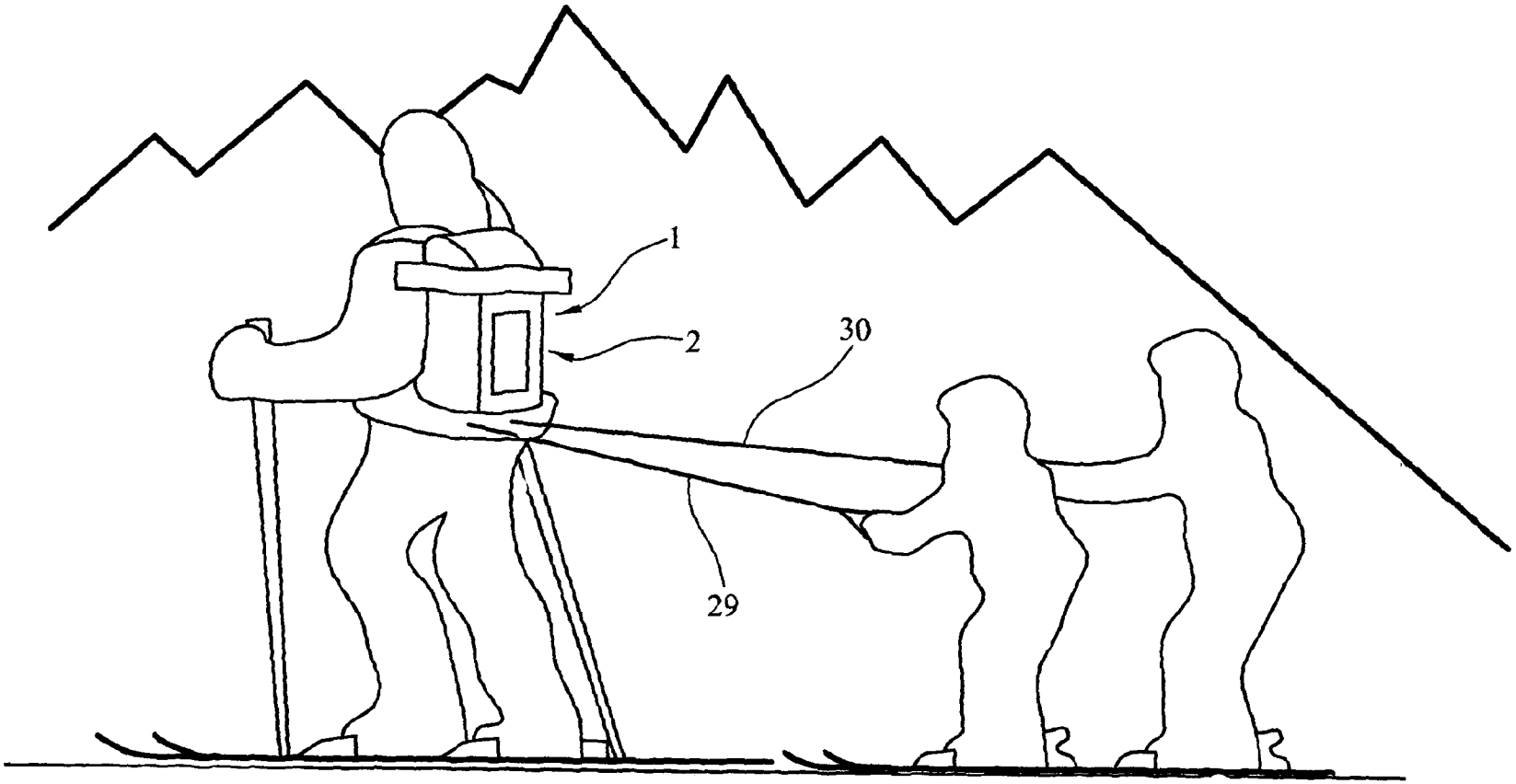

The invention will now be described solely by way of example and with reference to the accompanying drawings in which:

FIG. 1 is a perspective view of a backpack provided with a retractable towing belt assembly of the invention;

FIG. 2*a* is a cross-sectional plan view of the retractable towing belt assembly;

FIG. 2*b* is a perspective view of the retractable towing belt assembly;

FIG. 3*a* is a perspective view of a backpack of the invention with towing compartment closed;

FIG. 3*b* is a perspective view of a backpack of the invention with towing compartment open;

FIG. 4*a* is a perspective view of a waist bag or bum bag of the invention with the compartment closed;

FIG. 4*b* is a perspective view of a waist bag or bum bag of the invention with the compartment open; and FIG. 5 is a schematic view of the carrier, e.g. backpack, of the invention in use.

Referring to FIG. 1 a carrier 1 according to the invention comprises a backpack 2 provided with a pair of shoulder straps 3 and 4, a base compartment 5 and compartment opening 6 for housing a retractable towing belt assembly (not shown). In addition, the backpack 2 is provided with hook and loop (Velcro™) straps or looped straps 7 for retaining ski poles (not shown), a full width hook and loop (Velcro™) strap 8 for retaining skis (not shown) a large hook and loop (Velcro™) strap 9 for retaining child's skis. Also, the backpack 2 is provided with a ski goggle storage compartment 10, side storage pocket 11 and an MP3 player pocket 12 on one or both of the shoulder straps 3 and 4.

Referring to FIGS. 1*a* to 1*c*; FIG. 1*a* illustrates a hook and loop (Velcro™) strap 7 wherein one end 13 is provided with a loop 14 such that the strap 7 may fold upon itself and the other end 15 of the strap can feed through the loop 14. FIGS. 1*b* and 1*c* are views of the base compartment 5 provided with two pairs of apertures 16*a* and 16*b*. A cartridge or casing 17 of the retractable towing belt assembly is also shown and the cartridge is provided with a pair of corresponding apertures 18 and 19. A pair of hook and loop (Velcro™) straps 20 and 21 are fed through the casing apertures 18 and 19 and the corresponding compartment apertures 15 and 16, thus securing the casing in the compartment 5.

Referring to FIGS. 2*a* and 2*b* a retractable towing belt assembly casing e.g. cartridge, 17 houses rotatable reels 25 and 26 each of the reels 25 and 26 rotates about their corresponding spindle 27 and 28. Towing belts 29 and 30 are wound around the corresponding reels 25 and 26. The towing belts 29 and 30 protrude through apertures 31 and 32 in the casing 17 and the ends 33 and 34 of each of the towing belts 29 and 30 are provided with a handle 35 and 36. Each of the spindles 27 and 28 is hollow and housing a spring (not shown).

Referring to FIGS. 3*a* and 3*b* the compartment 5 is provided with closure means 20 in the form of a zipper. In FIG. 3*a* the zipper is in the closed position. In FIG. 3*b* the zipper is in the open position and the towing belts 29 and 30 and corresponding handles 35 and 36 protrude through the opening 6 of the compartment 5.

Referring to FIGS. 4*a* and 4*b* a waist bag or bum bag 21 comprises a bag 22 connected to a waist strap or belt 23. The bag is provided with a compartment 24 and an opening 37. The opening 37 is provided with closure means 38 in the form of a zipper. In FIG. 4*a* the zipper is in the closed position. In FIG. 4*b* the zipper is in the open position and towing belts 39 and 40 and corresponding handles 41 and 42 protrude through the opening 37 of the compartment 24.

Referring to FIG. 5 the schematic representation shows the carrier 1 in the form of a backpack 2, in use. The towing belts 29 and 30 are extended from the backpack 2 enabling, in the example shown, children to be towed along which the adult is able to ski comfortably.

The invention claimed is:

1. A carrier which includes a retractable towing belt assembly comprising: a housing provided with an aperture for communicating from the interior of the housing to the exterior; a rotatable reel located in the interior of the housing, the reel being provided with a biasing means providing torque in an inwardly winding direction; and, a tow belt having a first internal end located about and fixed to the reel and a second unfixed external end, the external end optionally being provided with a handle; and, a means for attaching the housing to the carrier, wherein the biasing means has a load of from 10 to 300 Newtons, and wherein the carrier includes an interior compartment for the housing to be placed within, and wherein the interior compartment and the carrier are a unitary piece.

2. A carrier according to claim 1 wherein the retractable towing belt assembly is provided as a separate unit.

3. A carrier according to claim 1 wherein the retractable towing belt unit comprises a single reel and belt arrangement.

4. A carrier according to claim 3 wherein the retractable towing belt unit comprises two or more reel and belt arrangements.

5. A carrier according to claim 1 wherein the carrier is provided with one or more straps attached to the carrier, the one or more straps each with a fastening means.

6. A carrier according to claim 1 wherein the carrier is a backpack.

7. A carrier according to claim 6 wherein one or more straps are attached to the carrier are suitable for carrying skis, ski poles, and the like.

8. A carrier according to claim 6 wherein the one or more straps attached to the carrier are suitable for carrying two or more pairs of skis and/or ski poles.

9. A carrier according to claim 1 wherein the carrier is a bum bag.

10. A carrier according to claim 1 wherein the compartment for the retractable towing belt assembly is located at the base of the backpack.

11. A retractable towing belt assembly which comprises: a housing provided with an aperture for communicating from the interior of the housing to the exterior; a rotatable reel located in the interior of the housing, the reel being provided with a biasing means providing torque in an inwardly winding direction; and a tow belt having a first internal end located about and fixed to the reel and a second unfixed external end, the external end optionally being provided with a handle; a means for attaching the housing to a carrier, wherein the biasing means has a load of from 10 to 300 Newtons, and wherein the carrier is provided with an interior compartment for the housing, and wherein the interior compartment and the carrier are a unitary piece.

12. A retractable towing belt assembly according to claim 11 wherein assembly comprises more than one reel and belt arrangement.

13. A retractable towing belt assembly according to claim 11 wherein the belt length is about 1.7 m.

14. A retractable towing belt assembly according to claim 11 wherein the rotatable reel comprises a hollow cylinder.

15. A retractable towing belt assembly according to claim 11 wherein the biasing means is located inside the hollow cylinder of the reel.

16. A retractable towing belt assembly according to claim 11 wherein the biasing means is a coiled spring.

17. A method of towing an object which comprises: providing a carrier which includes a retractable towing belt assembly comprising: a housing provided with an aperture for communicating from the interior of the housing to the exterior; a rotatable reel located in the interior of the housing, the reel being provided with a biasing means providing torque in an inwardly winding direction; and a tow belt having a first internal end located about and fixed to the reel and a second unfixed external end, the external end optionally being provided with a handle; a means for attaching the housing to the carrier; wherein the carrier is provided with an interior compartment for the housing connecting the object to the external end of the tow belt, and towing the object, and wherein the interior compartment and the carrier are a unitary piece.

* * * * *